US010350736B2

(12) United States Patent
Idir et al.

(10) Patent No.: US 10,350,736 B2
(45) Date of Patent: Jul. 16, 2019

(54) SLOGGING WRENCH

(71) Applicant: Stanley Works (Europe) GmbH, Dubendorf (CH)

(72) Inventors: Hadi Idir, Sevran (FR); Jeremy Lefevre, Fismes (FR); Rachid Hocini, Le Havre (FR)

(73) Assignee: Stanley Black & Decker MEA FZE, Jebel Ali, Dubai (AE)

( * ) Notice: Subject to any disclaimer, the term of this patent is extended or adjusted under 35 U.S.C. 154(b) by 1368 days.

(21) Appl. No.: 14/308,858

(22) Filed: Jun. 19, 2014

(65) Prior Publication Data

US 2014/0373686 A1 Dec. 25, 2014

(30) Foreign Application Priority Data

Jun. 21, 2013 (EP) ..... 13173285

(51) Int. Cl.

| | |
|---|---|
| ***B25B 13/48*** | (2006.01) |
| ***B25B 23/10*** | (2006.01) |
| ***B25B 19/00*** | (2006.01) |
| ***B25B 13/04*** | (2006.01) |

(52) U.S. Cl.

CPC ..... *B25B 23/108* (2013.01); *B25B 13/04* (2013.01); *B25B 19/00* (2013.01); *B25B 23/101* (2013.01); *B25B 23/105* (2013.01); *B25B 13/48* (2013.01)

(58) Field of Classification Search

CPC ..... B25B 23/108; B25B 13/04; B25B 19/00; B25B 23/101; B25B 23/105; B25B 21/02; B25B 15/02; B25B 13/48; B25B 27/02

See application file for complete search history.

(56) References Cited

U.S. PATENT DOCUMENTS 390,422 A * 10/1888 White ..... B25B 13/12 81/166
592,199 A * 10/1897 Fletcher ..... B25B 13/14 269/243

(Continued)

FOREIGN PATENT DOCUMENTS

CN 2892383 Y 4/2007
CN 201175878 Y 1/2009

(Continued)

*Primary Examiner* — Monica S Carter
*Assistant Examiner* — Danny Hong
(74) *Attorney, Agent, or Firm* — Caeden Drayton; Adan Ayala

(57) ABSTRACT

A slogging wrench (10) comprising: a ring socket (36) for receiving a nut or a bolt head (NBH, NBH'); an elongate body (20) for receiving blows from a mass to transmit torque to the ring socket; and a tool-free locking mechanism (22,24,26,26',28,30) for retaining a nut or a bolt head in the ring socket. The locking mechanism comprises a slider (22) operable to engage a nut or a bolt head in the ring socket; a channel (24) for guiding movement of the slider towards and away from the ring socket; and an actuator (30,74) manually operable to move the slider with respect to the ring socket. The channel (24) opens into the ring socket (36) via an internal periphery (40) of the ring socket. The locking mechanism comprises a resilient member (34) biasing the slider (22) towards a nut or a bolt head (NBH, NBH') in the ring socket (36).

3 Claims, 12 Drawing Sheets

(56) References Cited

U.S. PATENT DOCUMENTS

| | | | | | |
|---|---|---|---|---|---|
| 717,390 | A | * | 12/1902 | Gray | B25B 13/12 81/171 |
| 1,359,403 | A | * | 11/1920 | Lynds | B25B 13/16 81/166 |
| 1,396,867 | A | | 11/1921 | Miller | |
| 2,072,463 | A | | 3/1937 | Mims | |
| 3,104,570 | A | * | 9/1963 | Haenni | B25B 13/46 81/126 |
| 3,204,497 | A | * | 9/1965 | Dinkler | B25B 13/16 81/77 |
| 3,282,136 | A | | 11/1966 | Maichen | |
| 3,858,465 | A | | 1/1975 | Lind | |
| 3,867,855 | A | | 2/1975 | Siebert | |
| 4,151,763 | A | | 5/1979 | Colvin | |
| 4,174,646 | A | | 11/1979 | Kotler | |
| 4,300,415 | A | | 11/1981 | Saila | |
| 4,325,275 | A | | 4/1982 | Colvin | |
| 4,478,114 | A | | 10/1984 | Arena | |
| 4,766,786 | A | * | 8/1988 | Jeremic | B25B 13/16 81/129 |
| 4,787,275 | A | | 11/1988 | Colvin | |
| 4,967,613 | A | * | 11/1990 | Cone | B25B 13/16 81/166 |
| 4,987,805 | A | * | 1/1991 | Ejdenwik | B25B 13/12 81/155 |
| 5,230,264 | A | | 7/1993 | Kindling | |
| 5,415,064 | A | * | 5/1995 | Chang | B25B 13/12 81/166 |
| 5,606,896 | A | | 3/1997 | Shammout | |
| 5,685,206 | A | * | 11/1997 | Ma | B25B 13/04 7/139 |
| 5,862,722 | A | * | 1/1999 | Cislo | B25B 13/12 81/164 |
| 5,988,024 | A | | 11/1999 | Boyd et al. | |
| 6,000,100 | A | | 12/1999 | Montgelard | |
| 6,240,814 | B1 | | 6/2001 | Boyd et al. | |
| 6,318,776 | B1 | | 11/2001 | Lee | |
| 6,732,616 | B2 | | 5/2004 | Lin | |
| 6,973,857 | B1 | * | 12/2005 | Anderson | B25B 13/18 60/591 |
| 7,478,735 | B2 | | 1/2009 | Lorthioir et al. | |
| 7,481,330 | B2 | | 1/2009 | Lorthioir et al. | |
| 7,607,373 | B2 | | 10/2009 | Anderson | |
| 7,611,179 | B2 | | 11/2009 | Lorthioir et al. | |
| 8,235,245 | B2 | | 8/2012 | Lorthioir | |
| 8,365,420 | B2 | | 2/2013 | Pellenc | |
| 8,365,948 | B2 | | 2/2013 | Lorthioir | |

FOREIGN PATENT DOCUMENTS

| | | |
|---|---|---|
| DE | 20221584 | 6/2006 |
| FR | 2859657 | 3/2005 |
| FR | 2883787 | 10/2006 |
| FR | 2961733 | 12/2011 |
| TW | M433270 | 7/2012 |

* cited by examiner

SLOGGING WRENCH

The present invention relates to a slogging wrench with a locking mechanism.

Heavy equipment with large nuts or bolts, having a flat-to-flat dimension of between 20 and 200 millimeters, may be found in industrial environments such refineries, pipelines, mines, dockyards, railway facilities or agriculture. These nuts or bolts may be very difficult to loosen or properly tighten by reason of their size. Also, nuts or bolts may be very difficult to loosen by reason of being seized to the equipment to which they are fastened. In such circumstances, a slogging wrench may be preferred or even the only option for loosening or tightening.

Typically, slogging wrenches have a closed ring socket at one end for engaging a nut or bolt head and an anvil at an opposite end. The anvil end is for striking with a large mass or hammer to transmit high energy impulses to the socket end. In doing so, a nut or a bolt head may be loosened or tightened with greater torque than may be possible with an average wrench operated by a human arm. To withstand hammer impacts and greater torque, slogging wrenches are designed to be robust and sometime rather heavy. A slogging wrench's operating environment may involve high level work, access to awkward spaces or engagement with inverted nuts or bold heads. Even if the faces of the ring socket and the nut or bolt head are in close correspondence there must be some small amount of play between these faces otherwise the slogging wrench cannot be put on the nut or bolt head. This play, when subjected to repetitive hammer blows to the anvil end, may cause backlash in the connection between the nut and bolt head and the slogging wrench which may cause the latter to progressively work itself free.

Certain measures are taken to ensure that slogging wrenches do not disengage the nut or bolt head, especially in the case of high level work. A falling slogging wrench is a serious hazard to people passing below. Typically one operator holds the slogging wrench on the nut or bold head while another operator strikes the anvil end with a hammer. One operator's arms and hands are in close proximity to a swinging hammer. This has in the past led to physical injury. Consequently, the operator swinging the hammer tends to refrain from maximum effort for fear of injuring the operator holding the slogging wrench. Also, two operators are required to perform only one task.

Patent publication DE20221584U discloses a slogging wrench with a ring socket. The internal periphery of the ring socket has a grub screw to grip one flat side of a nut or bolt head to maintain the slogging wrench on the nut or bolt head. The grub screw is operated with a hex key. The grub screw is accessible from the outer periphery of the ring socket assuming that the work environment allows enough clearance for turning the hex key. If so, and if a hex key is available, the grub screw is progressively turned to engage or disengage the nut or bolt head which may be laborious. Also, the grub screw is orientated away from the central axis of ring socket which tends to spread locking forces unevenly about the internal periphery of the ring socket.

Patent publication FR2859657 discloses a slogging wrench with a ring socket and an additional socket linked by an elastic harness to the anvil end of the slogging wrench. The additional socket is connectable to another nut or bolt head to pull the slogging wrench in a direction that tightens the ring socket against the nut or bolt head. If this is not sufficient to prevent the slogging wrench from falling off, it will be caught by the harness before it falls too far.

Patent publication FR2883787 discloses a slogging wrench with a ring socket. A resilient ring inside the ring socket's inner periphery is deformable to eliminate play between the faces of the ring socket and a nut or bolt head.

Patent publication FR2961733 discloses a slogging wrench comprising a ring socket for receiving a nut or a bolt head, an elongate body for receiving blows from a mass to transmit torque to the ring socket, and a tool-free locking mechanism for retaining a nut or a bolt head in the ring socket. The locking mechanism comprises a threaded locking face biased into engagement with a threaded shaft and a manually operable lever to overcome the biasing force and retract of the slider away from the threaded shaft. This design of locking mechanism presupposes that a threaded shaft is always available to secure the slogging wrench. However, this is not always the case, as the skilled person will appreciate, because the threaded shaft is often concealed.

It is an object of the present invention to provide a slogging wrench with an improved locking mechanism for retaining a nut or a bolt head in the ring socket.

According to the present invention, there is provided slogging wrench comprising a ring socket for receiving a nut or a bolt head, an elongate body for receiving blows from a mass to transmit torque to the ring socket and a tool-free locking mechanism for retaining a nut or a bolt head in the ring socket, wherein the locking mechanism comprises a slider operable to engage a nut or a bolt head in the ring socket, a channel for guiding movement of the slider towards and away from the ring socket, and an actuator manually operable to cause movement of the slider with respect to the ring socket. The tool-free locking mechanism avoids the inconvenience of an absent or misplaced tool to operate a locking mechanism like the slogging wrench disclosed by DE20221584U. The actuator is manually operable to overcome engagement between the slider and a nut or bolt head which makes it easier to remove the slogging wrench after an operation has been performed, unlike the slogging wrench disclosed by FR2883787 which tends to stick to the nut or bolt head. The slider of the present invention may be operable by a locking mechanism similar to that used in a ball point pen or by a tool-free locking mechanism comprising an over-centre device similar to that use to fasten a ski boot, for example. The slider may be biased to operate in one direction by a compression spring and until overridden by a lever pulled in the opposite direction, similar to the arrangement disclosed by FR2961733. Advantageously, locking mechanism of the present invention reliably secures the slogging wrench because the slider directly engages the nut or a bolt head and in the ring socket. This avoids the need connect to another feature like, for example, a bolt thread which may not always be accessible.

Preferably, the channel opens into the ring socket via an internal periphery of the ring socket. The slider may engage the nut or bolt head inside the ring socket so that torque and engagement are applied to the same place. This reduces the height of the ring socket because the slider sunk is sunk inside its profile. The helps the ring socket to gain access to tight or awkward locations.

Preferably, the channel is at least partially within the body. The body provides at least some and possible all the channel. This may reduce the number of parts used to make the slogging wrench and reduce manufacturing cost.

Preferably, the channel is for guiding linear movement of the slider. Linear movement, especially sliding linear movement, is smother and less likely to foul. A linear channel is easier to manufacture, especially if the channel is machined into the body of the slogging wrench. Optionally, the channel is inclined in relation to a central longitudinal axis of the body. If the channel is machined into the body then an inclined channel provides the machining operation with a smooth entry point. The machining operation may end with an opening in the ring socket which provides an easy exit point.

Preferably, the locking mechanism comprises a complementary mating arrangement for retaining the slider within the channel. This arrangement allows the slider to slide within the channel without falling outside the channel.

Preferably, the complementary mating arrangement comprises at least one rail on each of the slider and the channel and wherein the or each rail of the slider is arranged for sliding engagement with a corresponding rail on the channel. Rail to rail sliding engagement is reliable and is uncomplicated to manufacture Preferably, the locking mechanism comprises a coupling between the actuator and the slider and wherein the coupling is arranged to introduce play in the locking mechanism. A small amount of play in the locking mechanism system may be beneficial to tolerate minor manufacturing discrepancies and assist assembly.

Preferably, the locking mechanism comprises an elongate control rod and wherein the actuator is coupled to the slider via the control rod. The control rod introduces greater flexibility in the design of the locking system because the slider and actuator need not be in close proximity.

Preferably, the locking mechanism comprises a resilient member and wherein the resilient member biases the slider to engage a nut or a bolt head in the ring socket. The resilient member provides reliable engagement between the slider and the nut or a bolt head unless, or until, manually overridden by the actuator.

Preferably, the actuator is rotatably coupled to the slider, wherein the actuator is rotatable about a fulcrum on the slogging wrench and wherein the fulcrum is arranged to provide operation of the actuator by rotation with a mechanical advantage over operation of the actuator by linear translation. This mechanical advantage may be a benefit for large diameter slogging wrenches having a large compression spring the bias of which may be difficult or tiresome to overcome by pulling in a linear direction.

Preferably, the actuator comprises an elongate handle for operation of the actuator. An elongate handle may increase the mechanical advantage of rotating the actuator about its fulcrum or an elongate handle may be easier for an operator to grasp. Optionally, the handle is arranged for one-handed operation of the actuator. For example, the handle may be squeezed against the body of the slogging wrench in the palm of an operator's hand. One-handed operation is facilitated by an elongate handle, especially if the handle is rotatable about a fulcrum.

Preferably, the fulcrum is transferrable to any one of a plurality of locations on the slogging wrench. This allows the operator to select a preferred mode of operation of the actuator.

Preferably, the slider comprises a profiled face arranged to engage at least one flat side or at least one corner of a nut or bolt head in the ring socket. This provides a flexible design of locking mechanism which may reliably engage a nut or a bolt head received in a twelve point ring socket. Advantageously, the operator need not intervene with operation of the locking mechanism irrespective of how the nut or bolt head may be oriented in the V-shaped slots of the ring socket.

Preferably, the profiled face is arranged for flush engagement with the at least one flat side or the at least one corner of a nut or bolt head in the ring socket. This provides surface-to-surface contact between the profiled face and the nut or bolt head which benefits the stability of the slogging wrench when being struck with a hammer.

Preferably, the profiled face is arranged to engage a flat side or a corner of a nut or bolt head in the ring socket. This provides a compact profiled face which engages only one flat side or one corner. The slider occupies less space within the ring socket. Advantageously, the slider reliably engages the nut or a bolt head in a radial direction towards the central axis of the ring socket. Thus, locking forces of the locking mechanism are spread evenly about the internal periphery of the ring socket. This improves stability of the slogging wrench on the nut or bolt head when receiving hammer blows.

Preferably, the slogging wrench comprises a flexible boot and wherein the boot shields at least some of the components of the locking mechanism. The boot helps to protect the moving parts of the locking mechanism from ingress of dirt. This helps to prolong the working life of the slogging wrench which is used in an inherently dirty environment.

Further features and advantages of the present invention will be understood by reference to the following description, which is given by way of example and in association with the accompanying drawings of which:

Figure 1:
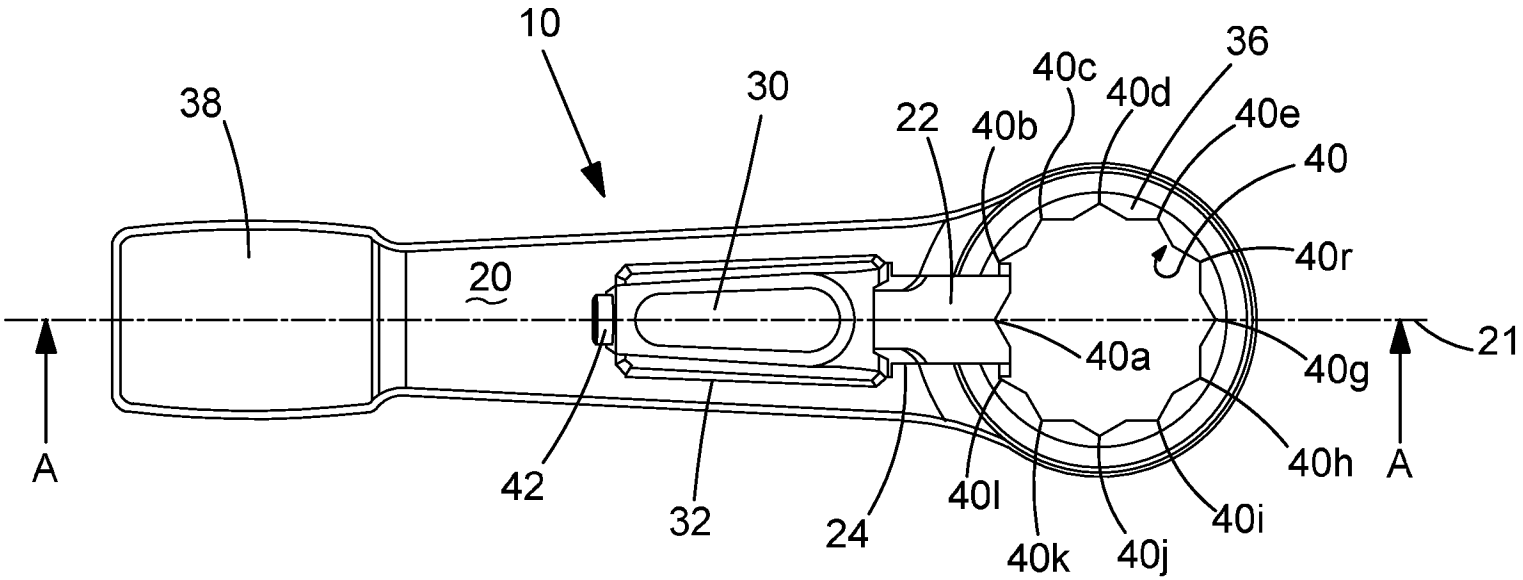
FIG. 1 shows a top view of a slogging wrench with a locking mechanism according to the present invention with the locking mechanism in an engaged position.

Referring to FIGS. 1 to 15, there is shown a slogging wrench 10 which comprises a wrench body 20, a slider 22 accommodated in a channel 24 in the body, a control rod 26 coupled by a pin 28 to the slider, a lever 30 coupled to the control rod, a cowl 32 which supports the control rod 26 and a compression spring 34 coiled about the control rod 26.

The wrench body 20 is an elongate forged body of steel. Grade 31CrV3 steel is preferred, although other suitable grades of steel may be used. The wrench body has a twelve point ring socket 36 at a first front end thereof and an anvil 38 at a second rear end thereof opposite the first end. The ring socket has an internal periphery 40 with a hardness of 39 to 44 HRc. The internal periphery has an array of twelve V-shaped notches 40*a* to 40*l* arranged at equiangular intervals of 30 degrees about the internal periphery. A first set of V-shaped notches 40*a*, 40*c*, 40*e*, 40*g*, 40*i*, 40*k* are adapted to engage a six-sided nut or bolt head having flat-to-flat diameter D of between 20 and 200 millimeters. A second set of V-shaped notches 40*b*, 40*d*, 40*f*, 40*h*, 40*j*, 42*l* are adapted to engage a six-sided nut or bolt head, albeit at 30 degrees clockwise or anti-clockwise rotation in relation to the first set of V-shaped notches. The anvil has an enlarged bulbous shape in relation to the middle of the wrench body. The anvil has rounded edges to help it withstand blows from a hammer, or other large mass, without resulting in fractures in the wrench body. A typical hammer used to strike the slogging wrench 10 may have a weight of about 2.8 kg. Optionally, the anvil may be equipped with a hook for suspending the slogging wrench during storage.

The slogging wrench 10 comprises a locking mechanism which is adapted to releasably engage with a nut or a bolt head located within the ring socket 26 and, in doing so, hold the slogging wrench on the nut or a bolt head until the locking mechanism is disengaged from the nut or a bolt head. The locking-mechanism is tool-free in the sense that it can be manually operated without recourse to a tool. The locking mechanism comprises the slider 22, the channel 24, the control rod 26, the pin 28, the lever 30 and the cowl 32 as is described in more detail below.

Figure 6:
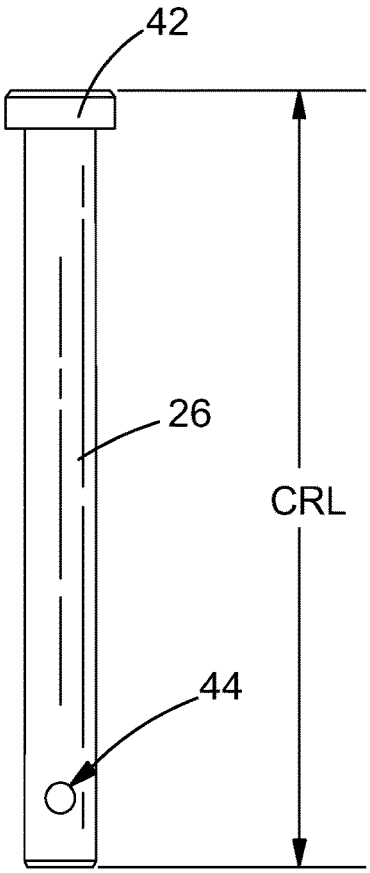
FIG. 6 shows a side elevation view of a control rod of the slogging wrench of FIG. 1.

Referring to FIG. 6 in particular, the control rod 26 is a metal elongate cylinder with a head 42 having an enlarged diameter at a first end thereof and a hole 44 passing through a portion of the control rod near a second end thereof opposite to the first end. The hole is located approximately 10% of the length CRL of the control rod from the second end of the control rod.

Figure 7:
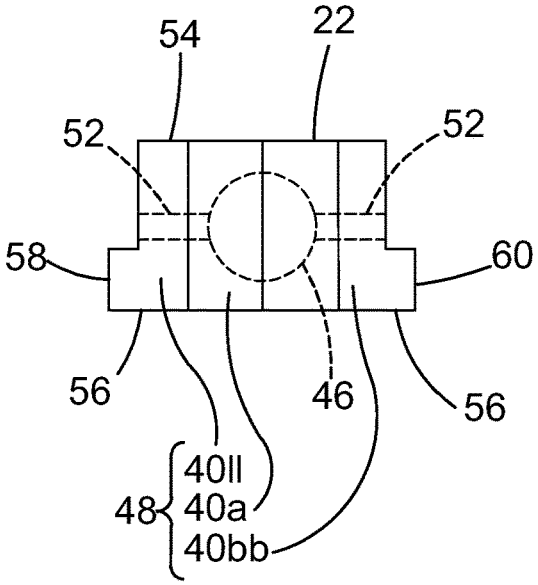
FIG. 7 shows a front elevation view of a slider of the slogging wrench of FIG. 1.
Figure 8:
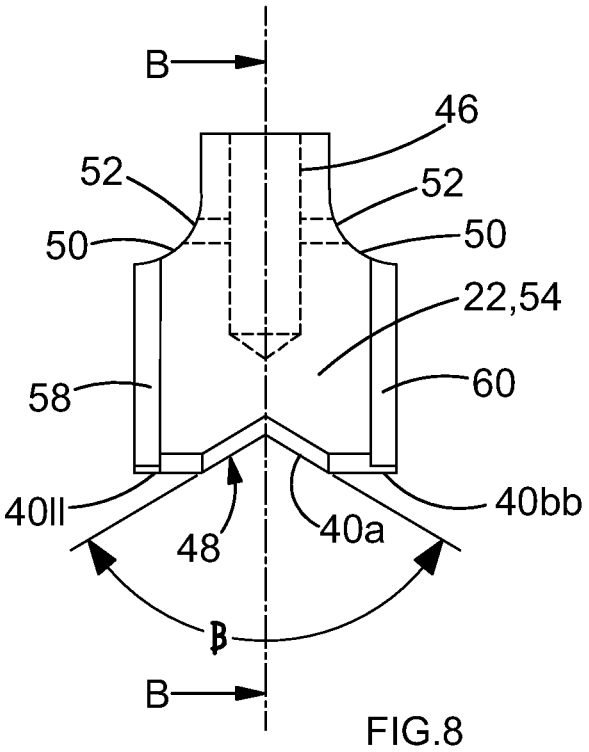
FIG. 8 shows a top view of the slider of FIG. 4.
Figure 9:
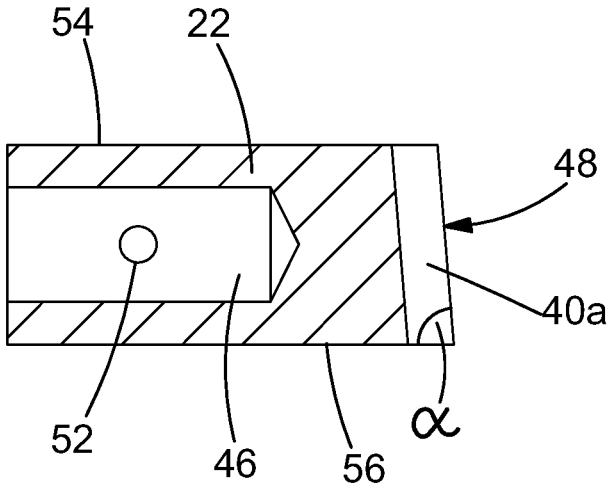
FIG. 9 shows a cross-sectional view B-B of the slider of FIG. 4.

Referring to FIGS. 7 to 9 in particular, the slider 22 is a solid metal block with a cylindrical blind hole 46 in a first rear end thereof and a profiled face 48 at a second front end thereof opposite the rear end. The rear end of the slider is narrower than the front end.

A transition between front and rear ends of the slider 22 is defined by a pair of shoulders of a shoulder section 50. The shoulder section 50 are traversed by a hole 52 that intersects the blind hole 46 at 90 degrees. The axes of the blind hole 46 and the hole 52 are coplanar in a plane generally parallel to and midway between top 54 and bottom 56 faces of the slider 22. The inner diameter of the blind hole 26 is slightly greater than the outer diameter of the second end of the control rod 26.

The front end of the slider 22 is flanked on either side by a bottom rail 58, 60 protruding outwardly from the bottom face 56 of the slider 22. The bottom rails are generally parallel to the axis of the blind hole 46. The profiled face 48 is inclined rearward towards the first end of the slider by an angle $\alpha$ of approximately 84 (eighty four) degrees measured from the bottom face 56 of the slider 22. The profiled face has a V-shaped notch which is an upper portion the V-shaped notch 40*a* of the ring socket's internal periphery 40. The V-shaped notch 40*a* in the profiled face 48 subtends an angle $\beta$ of 120 degrees as is the case with all the other V-shaped notches 40*b* to 40*l*. The V-shaped notch 40*a* of the profiled face is flanked on either side by a pair of parallel flats 40*bb*, 40*ll*. One flat 40*ll* is an upper portion of the clockwise half of the V-shaped notch 40*l* of the ring socket's internal periphery 40 and the other flat 40*bb* is an upper portion of the anti-clockwise half of the V-shaped notch 40*b* of the ring socket's internal periphery 40 as shown by the top views of the slogging wrench.

Figure 10:
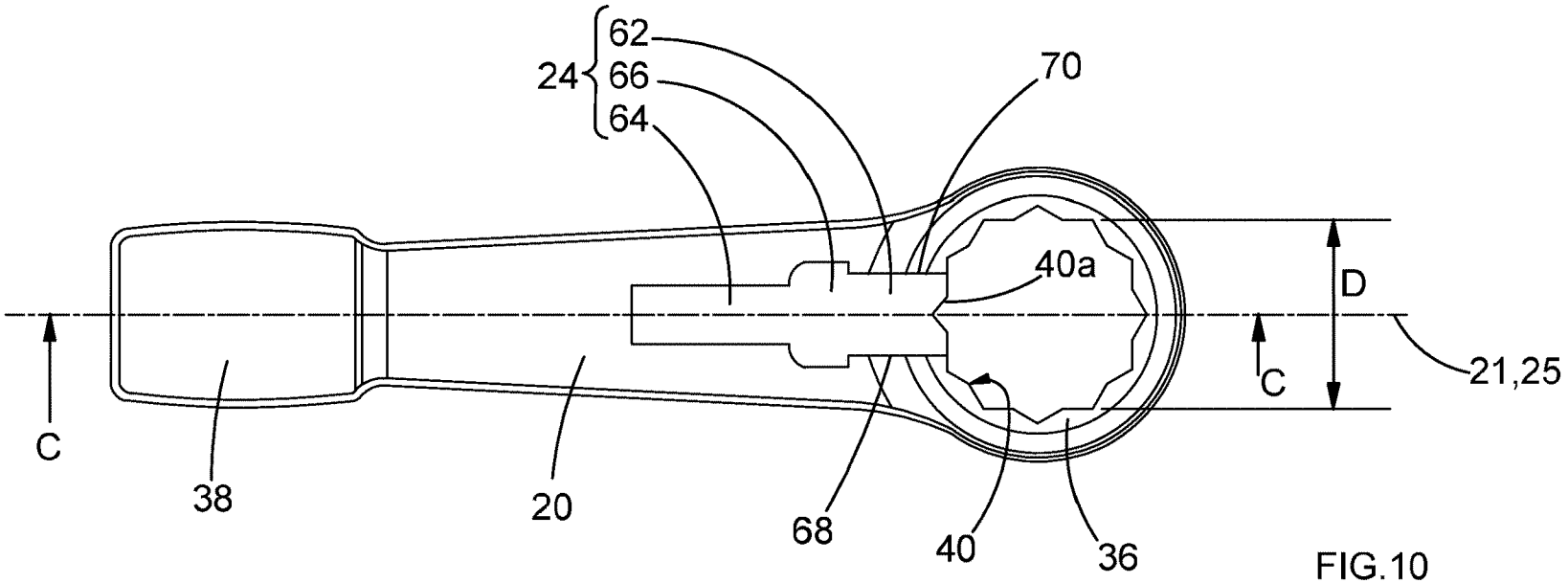
FIG. 10 shows the slogging wrench of FIG. 1 absent the locking mechanism.
Figure 11:
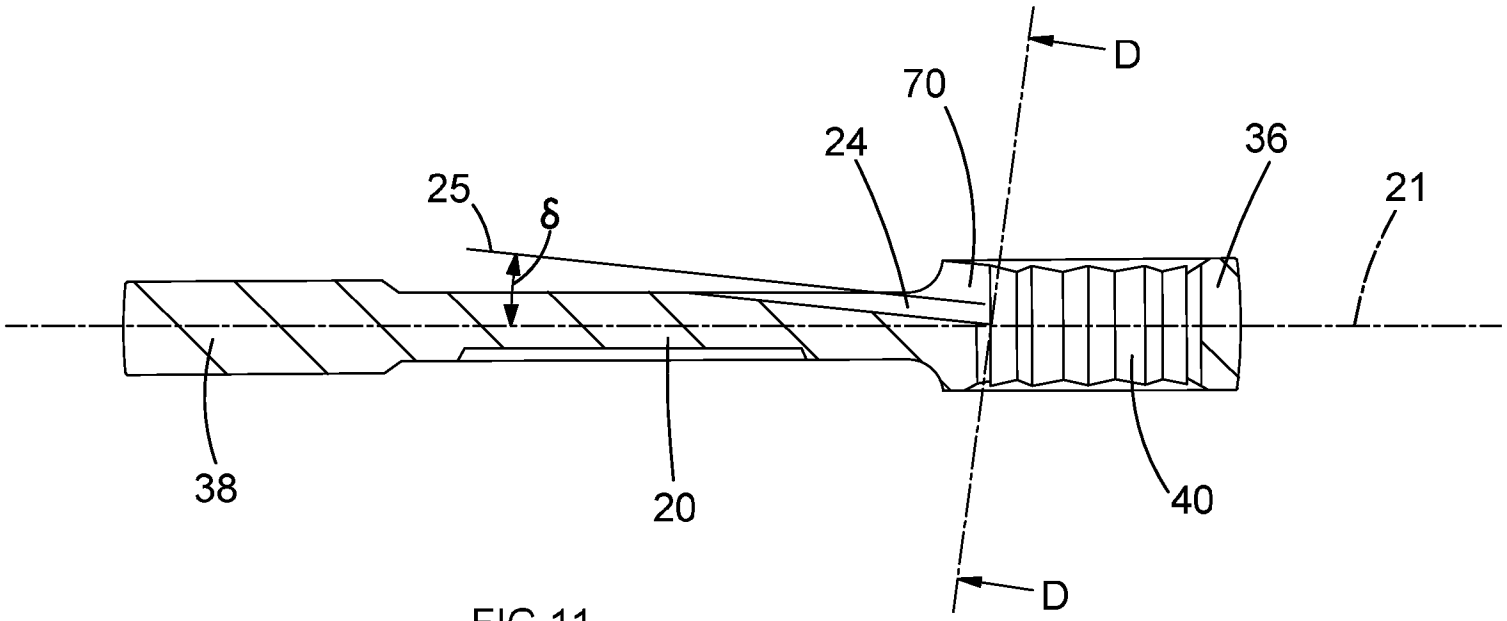
FIG. 11 shows the cross-sectional view C-C of the slogging wrench of FIG. 1 absent the locking mechanism.
Figure 12:
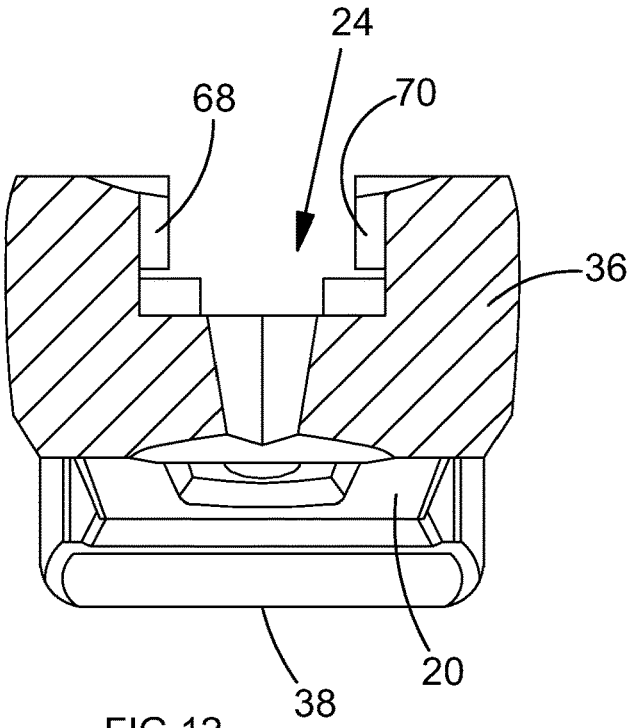
FIG. 12 shows a cross-sectional view D-D of the slogging wrench of FIG. 1 absent the locking mechanism

Referring to FIGS. 10 to 12 in particular, the channel 24 extends from approximately the midpoint of the wrench body 20 towards the front end of the wrench body 20 and opens into a side of ring socket's internal periphery 40 between the V-shaped notches 40*b* and 40*l*. A central longitudinal axis 25 of the channel 24 is inclined towards the rear end of the wrench body 20 by an angle $\delta$ of approximately 6 (six) degrees measured from a central longitudinal axis 21 of the wrench body. The sum of angles $\alpha$ and $\delta$ is 90 (ninety) degrees so that the profiled face 48 is parallel to the central axis of the internal periphery 40 of the ring socket 36. As such, the profiled face 48 may make flush engagement with the flat side or corner of a nut or bolt head in the internal periphery 40

The channel 24 has a front portion 62 which opens into the ring socket's internal periphery 40, a rear portion 64 which meets the top face of the wrench body 20 and a middle portion 66 between the rear and the front portions. Each side of the front portion has a top rail 68, 70 protruding outwardly from the top of the channel. The top rails begin at the ring socket's internal periphery 40 and end at the middle portion 66. The top rails are generally parallel to the central longitudinal axis 25 of the channel 24. The front portion 62 accommodates the slider 22 within the channel. A complementary mating arrangement between the slider's bottom rails 58,60 and the channel's top rails 68,70 retains the slider in the channel. The top and bottom rails guide linear sliding movement of the slider back and forth along the front portion 62 of the channel.

The channel 24 narrows at a transition between the middle portion 66 and the rear portion 64. This blocks the slider 22, or at least the front end of the slider, from sliding rearward beyond the middle portion of the channel. The rear portion 64 of the channel accommodates the control rod 26 and the compression spring 34 as is explained in more detail below.

Figure 13:
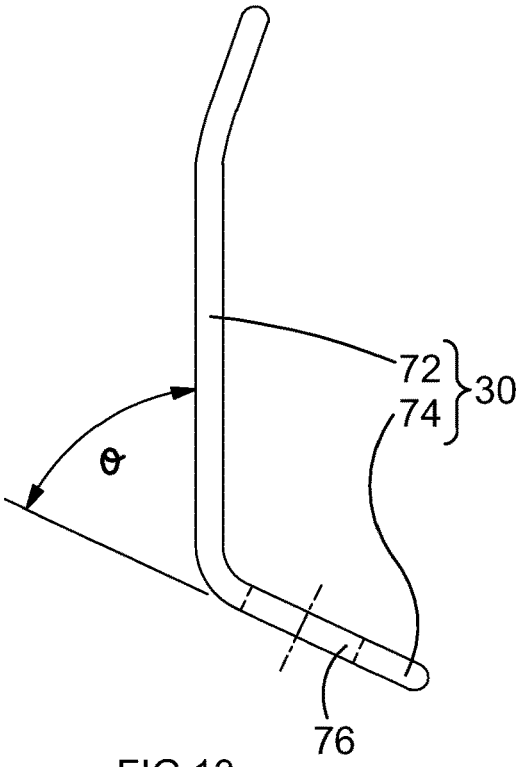
FIG. 13 shows a side elevation view of a lever of the slogging wrench of FIG. 1.

Referring to FIG. 13 in particular, the lever 30 is a solid metal plate with a handle 72 for manipulation by an operator and an actuator 74 bent by an angle $\theta$ of approximately 60 degrees in relation to the handle 72. The actuator has a hole 76 with an internal diameter which is sufficiently greater than the diameter of the control rod 26 to permit articulation between the lever 30 and the control rod 26. The hole 76 is smaller than the diameter of the head 42 of the control rod.

Figure 14:
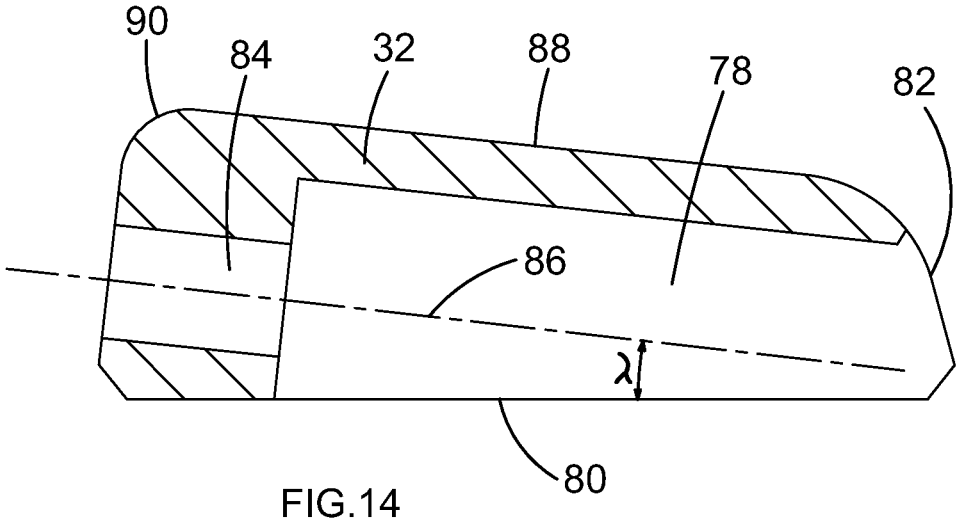
FIG. 14 shows a cowl of detail A absent of all other features of the slogging wrench.

Referring to FIG. 14 in particular, the cowl 32 is a solid forged or machined metal block with an internal cavity 78 which opens into a bottom face 80 and a first front end 82 thereof. A second rear end of the cowl 32 opposite the front end thereof has a cylindrical hole which acts as a bearing 84 for the control rod 26. A central longitudinal axis 86 of the control rod bearing 84 is inclined by an angle $\eta$ of approximately 6 (six) degrees measured from the bottom face 80 of the cowl 32. A curved shoulder located at a transition between the cowl's top face 88 and the rear end of the cowl acts as a bearing 90 for the lever 30.

Figure 15:
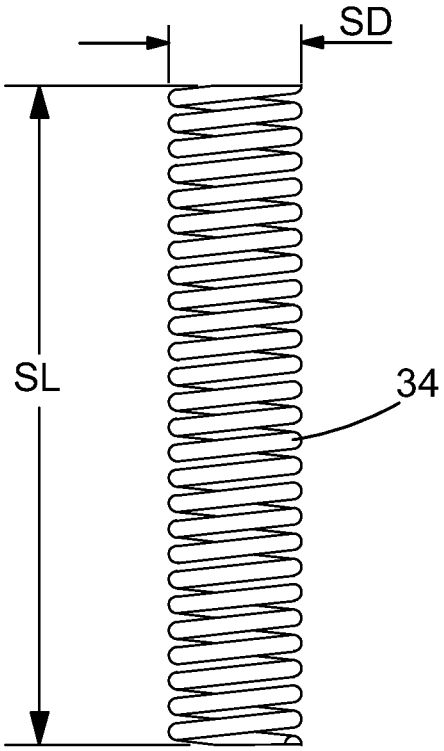
FIG. 15 shows a side elevation view of a spring of the slogging wrench of FIG. 1.

Referring to FIG. 15 in particular, the compression spring 34 has a length SL when not compressed. The compression spring 34 has an outer diameter SD which is greater than the inner diameter of the control rod bearing 84 of the cowl 32.

Returning to FIGS. 1 to 5, the bottom face 80 of the cowl 32 is connected to the top face of the wrench body 20 so that the cowl covers and protects the space around the rear 64 and middle 66 portions of the channel 24.

The front end of the control rod 26 is seated in the blind hole 46 of the slider 22. The pin 28 passes through the holes 52, 44 in the slider 22 and the control rod 26, respectively. The pin 28 is connected to slider 22 by an interference fit with the inside periphery of the hole 52, although other suitable connection means may be used such as glue or welding. A small amount of movement between the control rod 26 and the pin 28 is permitted by the blind hole 46 which has slightly greater inner diameter than the outer diameter of the control rod 26. This introduces a small amount of play between the control rod and the blind hole.

The first end of the control rod 26 is supported for sliding movement relative to the cowl 32 by the control rod bearing 84. The head 42 of the control rod 26 is located outside the rear end of the cowl 32. The lever's actuator 74 is located between the head 42 and the cowl 32. The control rod 26 passes through the actuator hole 76 and the control rod bearing 84. The small amount of play between the control rod 26 and the blind hole 46 compensates for any slight misalignment between the control rod bearing 84 and the blind hole. The compression spring 34 is held in compression between the control rod bearing and the slider 22. The compression spring biases the slider 22 to protrude from the channel 24 in to the ring socket 36 ready for engagement with a nut or bolt head, as is most clearly shown in FIG. 4. The small amount of play between the control rod 26 and the blind hole 46 also helps to absorb sudden movement of the slider 22 caused by impacts from hammer blows transmitted to the nut or bolt head without damaging the control rod 26.

The head 42 of the control rod 26 cannot pass through the actuator hole 76. The head 42 remains in abutment with the actuator 74 when the lever 30 is manipulated by an operator. The lever and actuator may be pulled backward towards the anvil 38 in the direction of arrow P to overcome the bias of the compression spring 34 and cause the slider 22 to recede from the ring socket 36 into the channel 24. The same result may be achieved when the lever's handle 72 is rotated in the direction of arrow R about a fulcrum F1 at a point of contact between the lever 30 and the lever bearing 90. The same result may also be achieved by rotation of the lever's handle 72 in an opposite direction to arrow R about a fulcrum F2 at a point of contact between the bottom of the actuator 74 and the cowl 32. The lever 30 may be turned about the central longitudinal axis 86 of the control rod bearing 84 to relocate fulcrum F1 to a point of contact between the lever 30 and a side face of the cowl. Here, rotation of the lever 30 in the direction of arrow R towards the cowl's side face may also overcome the bias of the compression spring 34 and cause the slider 22 to recede from the ring socket 36 into the channel 24. The slider disengages a nut or bolt head in the ring socket 36 when it recedes into the channel.

The fulcrum F1,F2 is always closer to the head 42 of the control rod 26 than the tip, or even the midpoint, of the handle 72 of the lever 30. Rotation of the lever either in the direction of arrow R, or in the opposite direction, provides a mechanical advantage which reduces the effort required to disengage the slider 22. This is a particular benefit for medium and large diameter slogging wrenches having a large compression spring 34 the bias of which may be difficult or tiresome to overcome by pulling in direction P.

Figure 2:
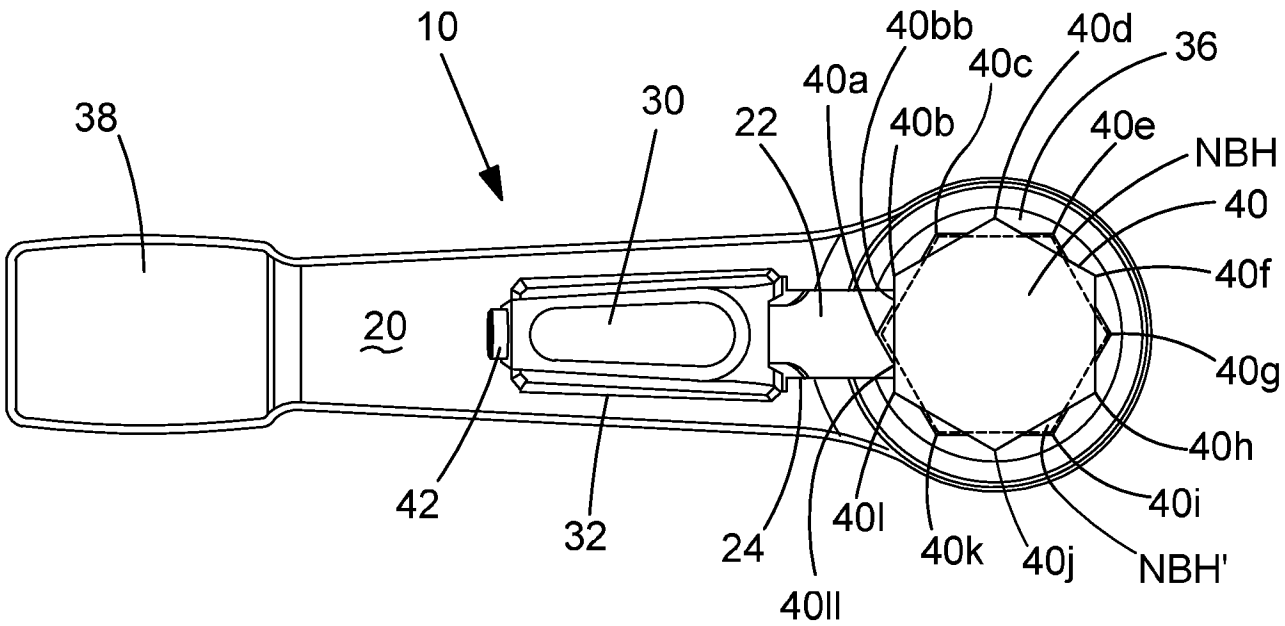
FIG. 2 shows a top view of the slogging wrench of FIG. 1 with the locking mechanism in a disengaged position.
Figure 3:
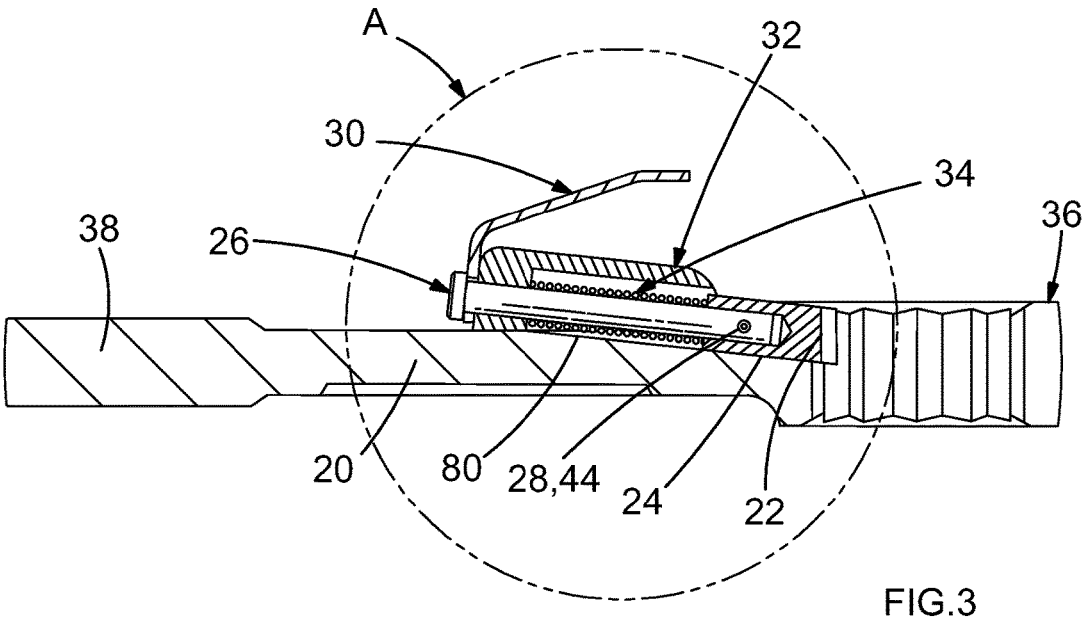
FIG. 3 shows a cross-sectional view A-A of the slogging wrench of FIG. 1 with the locking mechanism in the position of FIG. 1.
Figure 4:
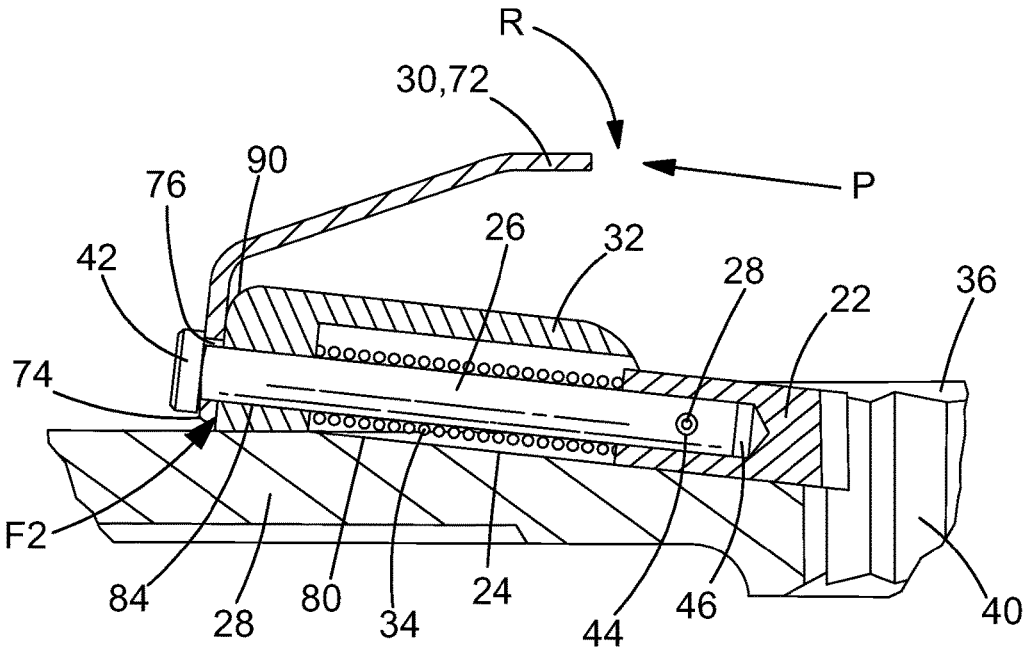
FIG. 4 shows a detail A of the slogging wrench of FIG. 1 with the locking mechanism in the position of FIG. 1.
Figure 5:
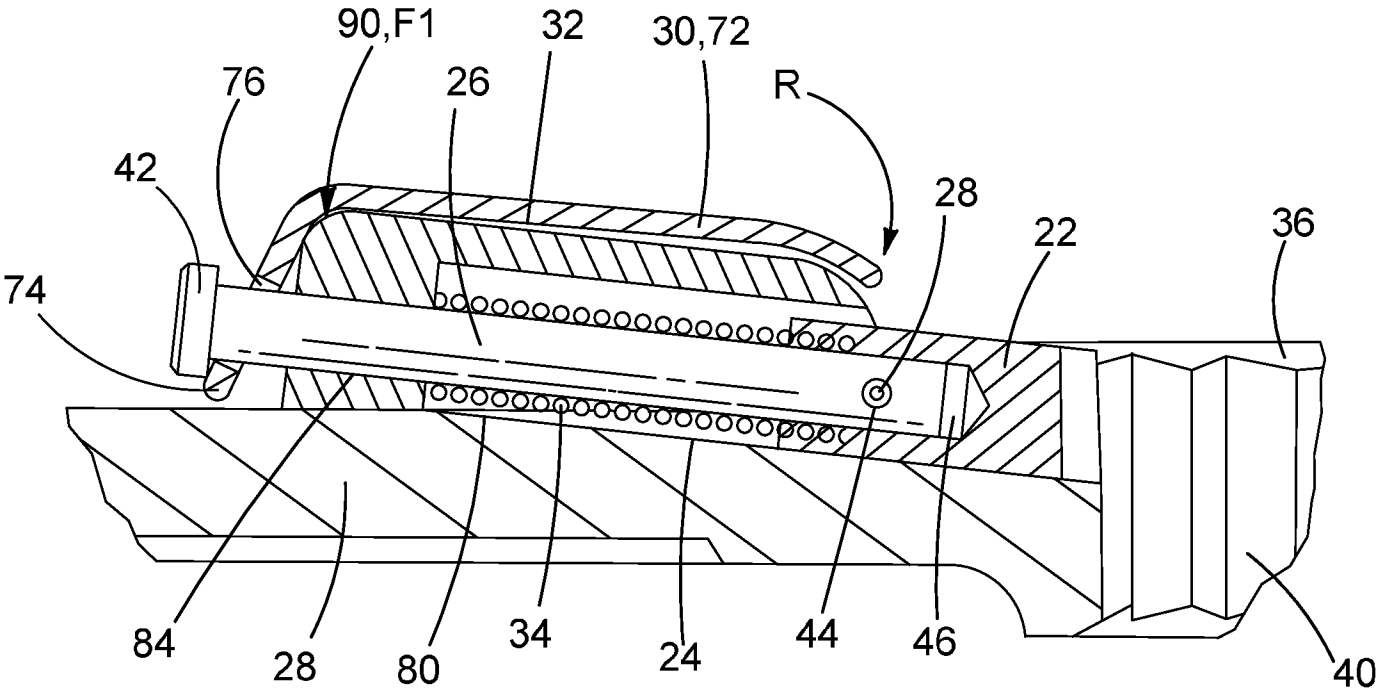
FIG. 5 shows a detail A of the slogging wrench of FIG. 1 with the locking mechanism in the position of FIG. 2.

The twelve point ring socket 36 can hold a nut or bolt head at twelve different equiangular spaced intervals of 30 (thirty) degrees. This provides additional flexibility in the use of the slogging wrench 10, especially in cramped locations where manoeuvrability may be limited. As is best shown in FIG. 2, the profiled face 48 is aligned with the ring socket's internal periphery 40 when the slider 22 is disengaged from a nut or bolt head and receded within the channel 24. As mentioned above, the profiled face provides a portion of V-shaped notch 40*a* and a portions 40*bb*, 40*ll* of the adjacent V-shaped notches 40*b*, 40*l*. When the locking mechanism is released, the slider may engage a flat side of the nut or bolt with the portions 40*bb*, 40*ll* (as is shown by the nut or bolt head NBH in continuous lines) or it may engage a corner of the nut or bolt head with the V-shaped notch 40*a* (as is shown by the nut or bolt head NBH' in dashed lines).

The slogging wrench 10 has a flexible design of locking mechanism. Normally, the compression spring 34 biases the slider 22 and the rest of the ring socket 36 into engagement with a nut or bolt head located therein. Engagement of the slider prevents the slogging wrench from falling from the nut or bolt head, even when inverted. There are several different ways to manipulate the handle 72 of the lever 30 to overcome the bias of the compression spring, disengage the slider 22 from the nut or bolt head and remove the ring socket 36. The choice of manipulation depends on operator preferences and operating conditions.

The slider 22, the control rod 26, the pin 28, the lever 30 and the cowl 32 of the locking mechanism are individual components which may be removed and replaced for maintenance or repair when required.

Figure 16:
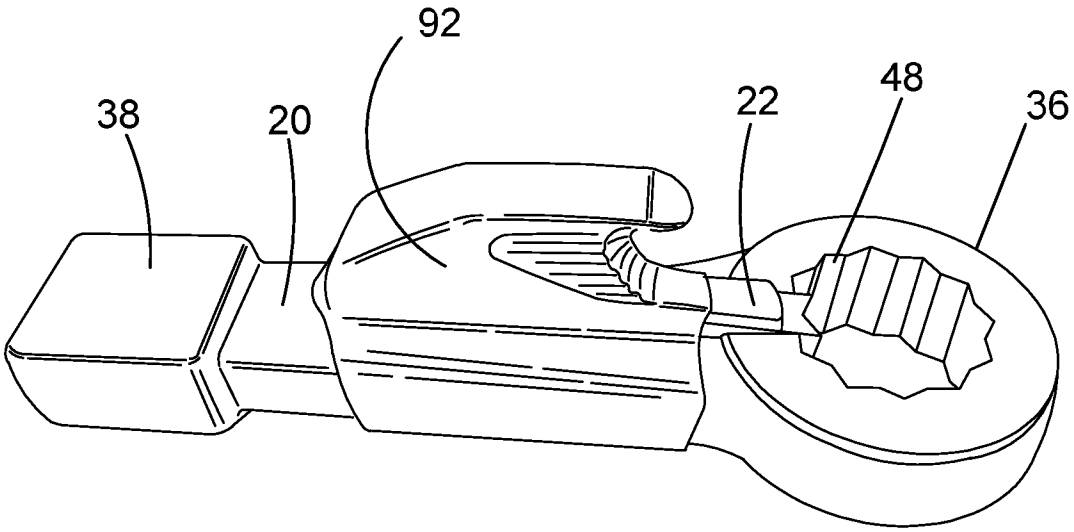
FIG. 16 shows a perspective view of an alternative embodiment of the slogging wrench with a flexible boot shielding the components of the locking mechanism.

Referring to FIG. 16, there is shown the slogging wrench 10 with a flexible rubber boot 92 that covers a portion of the wrench body 20 and components of locking mechanism such as the channel 24, the control rod 26, the pin 28, the lever 30 and the cowl 32. The boot also covers the slider 22 except for the front part of the slider and the profiled face 47 when they protrude from the channel 24 into the internal periphery 40 of the ring socket 36. The flexibility of the rubber permits manual operation of the lever through the boot. The boot shields the components of the locking mechanism from ingress of dirt which may cause damage and impair movement.

Figure 17:
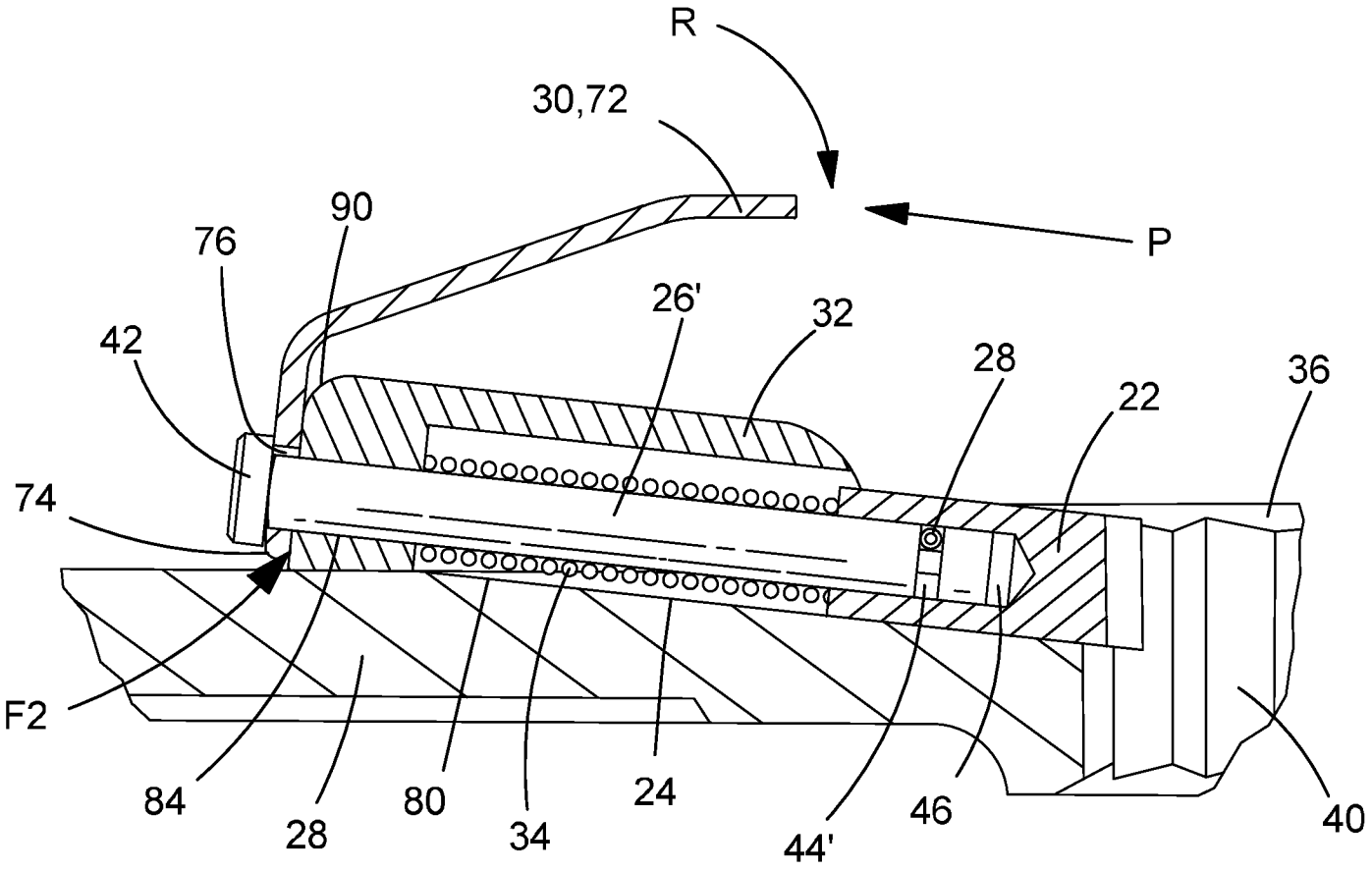
FIG. 17 shows detail A of the slogging wrench like that shown in FIG. 4 with an alternative embodiment of the locking mechanism.

Referring to FIG. 17, there is shown an alternative embodiment of the locking mechanism with a modification to the control rod of a medium or large diameter slogging wrench 10 used to tighten, or loosen, nuts or bolts having a flat-to-flat dimension of 36 mm or more. With the modified control rod 26', the hole 44 has been substituted for an annular channel 44' circumscribing a portion of the control rod 26' near the second end thereof. The annular channel 44' is located approximately 10% of the length CRL of the control rod 26' from the second end of the control rod. The annular channel 44' is sized to accommodate the pin 28 as it passes through the annular channel 44' substantially perpendicular to the direction of elongation of the control rod 26'. The hole 52 though the slider 22 is relocated a small distance either towards the top face 54 of the slider 22 (as is shown in FIG. 17) or towards the bottom face 56 of the slider 22 (when the pin 28 passes under the axis of elongation of the control pin 26') to compensate for the pin 28 being eccentric to the plane containing the axis of the blind hole 46 in the slider 22. The annular channel 44' acts as a collar around the pin 28 which couples the control rod 26' to the slider 22.

During assembly of the alternative embodiment of the locking mechanism, the control rod 26' is positioned in the blind hole 46 where the annular channel 44' is in line the hole 52 through the slider 22. The pin 28 may engage the annular channel 44' irrespective of the rotational position of the control rod 26' about its axis of elongation. This facilitates assembly of the locking mechanism because the hole 52 through the slider 22 does not need to be aligned precisely with a hole though the control rod 26'. The annular channel 44' introduces a small amount of play between the control rod 26' and the pin 28 which helps to absorb any stack-up of tolerances in the locking mechanism components.

The reference numbers used in the following claims are for convenience only and do not limit the scope of the claims in any way.

The invention claimed is:

1. A slogging wrench (10) comprising:

a ring socket (36) for receiving a nut or a bolt head (NBH, NBH'); an elongate body (20) for receiving blows from a mass to transmit torque to the ring socket; and a tool-free locking mechanism (22,24,26,26',28,30) for retaining a nut or a bolt head in the ring socket, characterized in that the locking mechanism comprises: a slider (22) operable to engage a nut or a bolt head in the ring socket; a channel (24) inclined in relation to a central longitudinal axis (21) of the body (20) for guiding movement of the slider towards and away from the ring socket; a resilient member (34) and wherein the resilient member biases the slider (22) to engage a nut or a bolt head (NBH, NBH') in the ring socket (36); and an actuator (30,74) operable to cause movement of the slider with respect to the ring socket, and wherein the actuator (30, 74) is rotatably coupled to the slider (22); wherein the actuator (30,74) is rotatable about a fulcrum (F1,F2) on the slogging wrench and wherein the fulcrum is arranged to provide operation of the actuator by rotation with a mechanical advantage over operation of the actuator by linear translation.

2. A slogging wrench (10) as claimed in claim 1, wherein the actuator (30,74) comprises an elongate handle (72) for operation of the actuator, wherein the handle is arranged for one-handed operation of the actuator.

3. A slogging wrench (10) as claimed in claim 1, wherein the fulcrum (F1,F2) is transferrable to any one of a plurality of locations (90) on the slogging wrench.

* * * * *